US006868608B2

(12) United States Patent
Theriault et al.

(10) Patent No.: US 6,868,608 B2
(45) Date of Patent: Mar. 22, 2005

(54) PLATE HANDLING WITH THERMAL TENSIONING

(75) Inventors: Edwin G. Theriault, Hudson, NH (US); James V. Lovenstein, Nashua, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 10/643,036

(22) Filed: Aug. 18, 2003

(65) Prior Publication Data

US 2005/0039315 A1 Feb. 24, 2005

(51) Int. Cl.[7] ..... B21K 1/02
(52) U.S. Cl. ..... 29/895.212; 29/447; 101/477
(58) Field of Search ..... 29/895.212, 447; 492/18, 492/38; 101/142, 477; 264/342 R; 242/909

(56) References Cited

U.S. PATENT DOCUMENTS 2,219,085 A * 10/1940 Watson ..... 29/895.2
3,759,800 A 9/1973 Reinke ..... 204/16
4,025,751 A * 5/1977 Wright ..... 219/216
4,026,208 A 5/1977 Horne, Jr. et al. ..... 101/116
4,134,340 A 1/1979 Larson ..... 101/127.1
4,779,337 A 10/1988 Keller ..... 29/800
4,890,785 A * 1/1990 Sakaguchi et al. ..... 228/232
4,930,205 A * 6/1990 Tasse ..... 29/450
5,224,423 A * 7/1993 Borel ..... 101/415.1
5,452,657 A 9/1995 Kurz ..... 101/216
5,477,779 A 12/1995 Kawabe ..... 101/116
5,678,487 A * 10/1997 Guaraldi et al. ..... 101/415.1
5,727,749 A * 3/1998 Pensavecchia et al. .. 242/538.3
6,202,556 B1 3/2001 Lagger ..... 101/216

* cited by examiner

*Primary Examiner*—Eric Compton
(74) *Attorney, Agent, or Firm*—Testa, Hurwitz & Thibeault, LLP

(57) ABSTRACT

Printing plates are mounted onto a cylinder by first establishing a temperature difference between the plate and the cylinder; in particular, the temperature of the plate exceeds the temperature of the cylinder. The plate is then wrapped around the plate cylinder, and the temperature difference causes the plate to shrink against the cylinder.

15 Claims, 2 Drawing Sheets

PLATE HANDLING WITH THERMAL TENSIONING

FIELD OF THE INVENTION

The present invention relates to digital printing apparatus and methods, and more particularly to a system for handling recording media such as lithographic printing members.

BACKGROUND OF THE INVENTION

In offset lithography, an image is present on a printing plate as a pattern or "image" of ink-accepting (oleophilic) and ink-repellent (oleophobic) surface areas. In a typical sheet-fed offset press system, the imaged plate is mounted to a plate cylinder, where it is inked. The plate is then brought into contact with the compliant surface of a blanket cylinder. The blanket cylinder, in turn, applies the image to paper sheets which are brought into contact with the blanket cylinder by an impression cylinder. Although the plates for offset presses were traditionally imaged photographically, more recently, a number of electronic alternatives have been developed for placing the image onto the plate. These digitally controlled imaging devices include lasers that chemically alter or destroy one or more plate layers, ink jets that directly deposit ink-repellent or ink-accepting spots on a plate blank and spark or ion discharge devices which physically alter the topology of the plate blank. These various imaging approaches are described in detail in U.S. Pat. Nos. 3,506,779; 4,054,094; 4,347,785; 4,911,075 and 5,385,092, among others.

Plates can be imaged on-press or, more traditionally, on an off-press platesetter. A digitally operated platesetter includes an imaging cylinder to which the plate is initially mounted, and which carries the plate past the head of the imaging device. That device transfers the image to the plate. The imaged plate is then removed from the platesetter and transferred to the plate cylinder of the printing press. Whenever a plate is mounted to a cylinder (either on a press or on a platesetter), it is essential that the leading and trailing edges of the plate be secured firmly to the cylinder and that the plate be wrapped tightly around the cylinder. This ensures that there will be no relative movement between the plate and the cylinder when the cylinder is rotated, as well as overall uniformity of imaging.

One condition that can interfere with smooth, consistent contact between the plate and the cylinder is plate expansion caused by temperature differentials. A printing plate is typically a multilayer construction including, for example, polymeric and metal layers, and is therefore subject to thermally induced expansion. A plate cylinder or, especially, a platesetter's imaging cylinder that may run numerous successive jobs, can become hotter than the surrounding environment. As a result, when a plate at room temperature encounters the cylinder, it expands. As the plate is wrapped around the cylinder, this expansion occurs progressively, affecting different areas of the plate at different times and leading to mechanical distortions. For example, a traditional sheet-form plate is loaded by first securing its leading edge to the cylinder using a clamp. The cylinder is rotated with the plate under tension in order to ensure tight contact against the cylinder. This tight contact, however, while essential to avoid slippage during imaging (and, especially, during printing), actually prevents dimensional expansion of the plate. As a result, the plate puckers, creating an uneven surface that interferes with the imaging process (and can lead, for example, to blurred images or even deleterious contact with the imaging head) and potentially with subsequent printing as well.

DESCRIPTION OF THE INVENTION

Brief Summary of the Invention

In accordance with the present invention, before plates are mounted to a cylinder, a temperature difference is established; in particular, the temperature of the plate exceeds the temperature of the cylinder. The plate is then wrapped around the the cylinder, and the temperature difference causes the plate to shrink against the cylinder. In this way, unwanted expansion is avoided, and plate shrinkage actually enhances its contact with the cylinder.

Accordingly, in a first aspect, the invention comprises a method of mounting a printing plate on a cylinder. In accordance with the method, a temperature difference is established between the plate and the cylinder, with the plate temperature exceeding the cylinder temperature. The plate is wrapped around the cylinder, and the temperature difference causes the plate to shrink against the cylinder. The temperature difference is generally at least 3° C., and typically 3–8° C. The temperature difference may be established by heating the plate or by cooling the cylinder.

In another aspect, the invention comprises an apparatus for mounting a printing plate on a cylinder. The apparatus comprises means for establishing a temperature difference between the plate and the cylinder such that the plate temperature exceeds the cylinder temperature, and means facilitating wrapping the plate around the cylinder. Once again, the temperature difference causes the plate to shrink against the cylinder.

The facilitating means may comprise registration pins and clamps, and the means for establishing a temperature difference may comprise a heater for heating the plate (e.g., by conduction, convection, or radiation) or a cooling system for reducing the temperature of the cylinder.

In some embodiments, the plate is drawn from a roll disposed within the interior of the cylinder and advanced around its exterior surface. Once again, the roll may be heated or the exterior surface of the cylinder may be cooled.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1A:
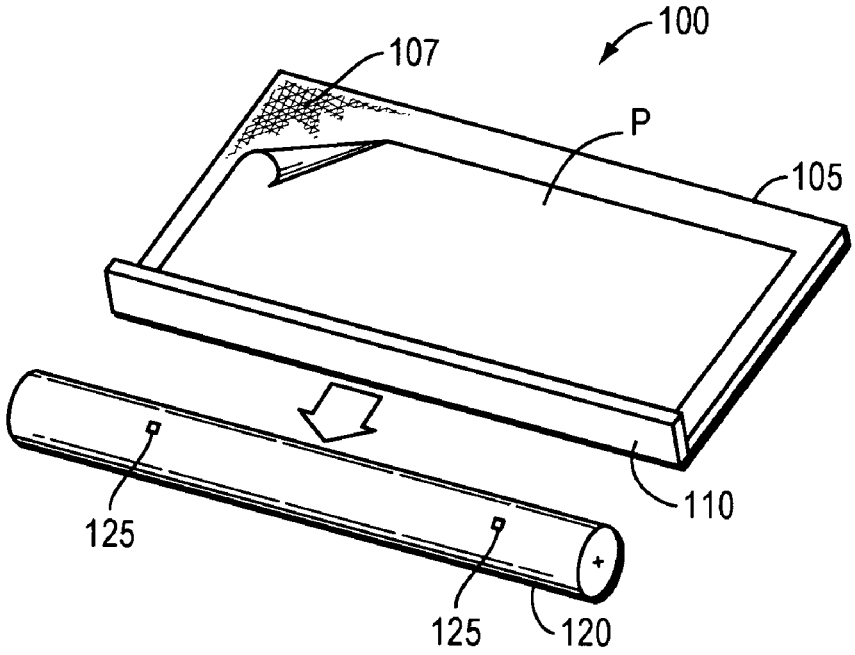
FIG. 1A is a schematic perspective view of a plate-handling system in accordance with the present invention.
Figure 1B:
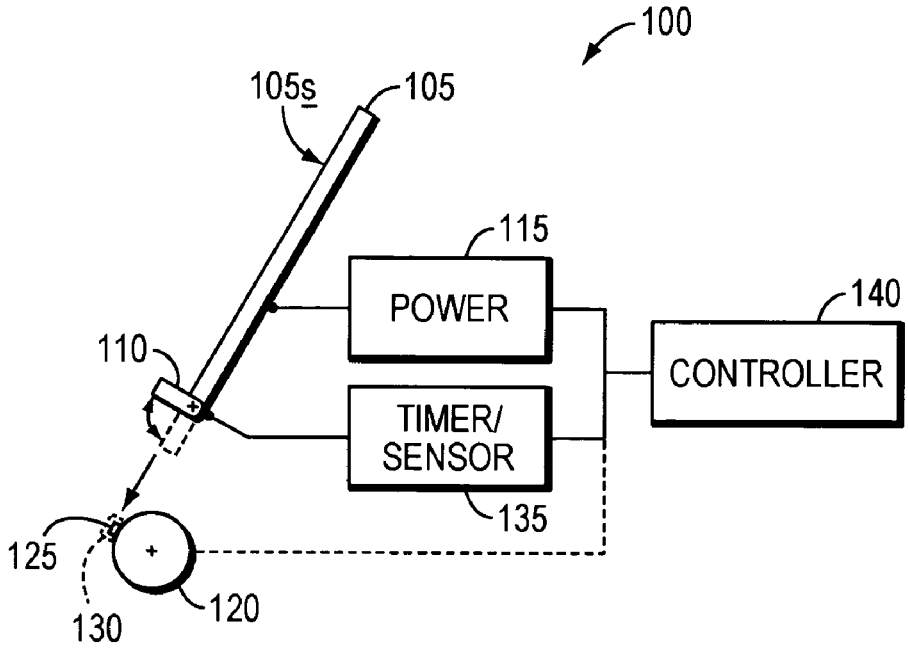
FIG. 1B is a side schematic view of a the plate-handling system shown in FIG. 1.

With reference to FIGS. 1A and 1B, a plate-handling system 100 in accordance with the invention includes a support platen 105 and a pivoting base member 110 along the bottom of the platen. In the embodiment to which the following description relates, support platen 105 has a surface 105*s* that may be heated to a predetermined temperature. For example, platen 105 may be a glass sheet with resistive wires embedded therein and arranged in a grid pattern. The dimensions of platen 105 are at least equal to, and generally exceed at least slightly, the dimensions of a printing plate P so that the plate is uniformly heated. Alternatively, platen 105 may simply be mounted on a separate heating element, or heated air (or a heat lamp) can be directed at plate P; indeed, plate P can simply be heated in an oven and returned to an unheated platen 105. In embodiments in which platen 105 is in fact heated, the heating element(s) associated with platen 105 receive power from a power supply 115 (FIG. 1B).

The plate P is supported by base 110 when the base is in its retracted position as illustrated, allowing plate P to remain in contact with the platen surface 105*s*. When the temperature of plate P reaches a temperature exceeding that of a cylinder 120, base 110 swings down into an extended position aligned with the surface of cylinder 120. As a result, plate P slides toward cylinder 120 along a travel path indicated by the arrow in FIG. 1B. The leading edge of plate P meets the surface of cylinder 120 and is aligned therewith by notches (not shown) in the plate edge that receive complementary alignment pins 125 on the cylinder surface. The leading edge plate P is clamped to cylinder 120 by a conventional plate clamp 130, and as cylinder 120 rotates, the plate P is wrapped around the cylinder surface. The trailing edge of the plate is secured to the surface of cylinder 120 by another plate clamp (not shown). Because the temperature of plate P exceeds that of cylinder 120, the plate does not expand as it wraps around the cylinder surface. (Additional hardware involved in the wrapping operation, including the cylinder motor, handoff assemblies, a roller for bringing the plate into intimate contact with the cylinder, and automatic clamping devices, is conventional in the art and therefore is not illustrated. It is to be understood, however, that the wrapping and clamping operations can also be performed manually.)

Base 110 rotates on a pivot as illustrated, and may, if desired, mechanically lock in either (or both) positions for stability. Extension and retraction of base 110 may be effected by any suitable movement mechanism, e.g., a hydraulic or pneumatic lift system, which preferably is actuable automatically. In particular, the system 100 may be responsive to a timer or sensor unit 135, which determines when the plate P, resting against the heated surface 105*s*, has reached the appropriate temperature. Preferably, that temperature is at least 3° C., and generally 3–8° C., higher than that of cylinder 120. If, for example, the average operating temperature of cylinder 120 is known, a simple temperature sensor (not shown) may indicate the temperature of plate P to unit 135. The sensor may be, for example, an optical sensor directed toward plate P, a thermocouple in contact with plate P, or any other suitable arrangement providing an electronic indication of temperature. Alternatively, if the thermal properties of the plate and the time-temperature behavior of platen 105 are well-characterized, unit 135 may be a simple timing circuit, which cuts off power supply 115 when the plate P is presumed to have reached the appropriate temperature.

In general, a controller 140 supervises the operation of power supply 115 and timer/sensor unit 135. Controller 140 may, for example, detect the presence of a plate on platen 105 and activate power supply 115. When controller 140 receives an indication from unit 135 that the plate has reached the appropriate temperature, it actuates the movement mechanism operating base 110 to cause extension thereof.

Ordinarily, the temperature of cylinder 120 varies during operation; in a platesetter, for example, a typical operating range is about 27–29° C. Consequently, obtaining a particular temperature difference between plate and cylinder (as opposed to a high enough plate temperature to exceed, by a given amount, the maximum expected cylinder temperature) may require monitoring of the cylinder temperature. This operation, too, may be performed by controller 140, e.g., by means of an additional temperature sensor connected to unit 135.

In an alternative approach, the temperature difference is established by cooling the cylinder rather than heating the plate. In this case, refrigeration coils are disposed within the cylinder, or the cylinder is exposed to refrigerated air prior to contact with the plate.

Figure 2:
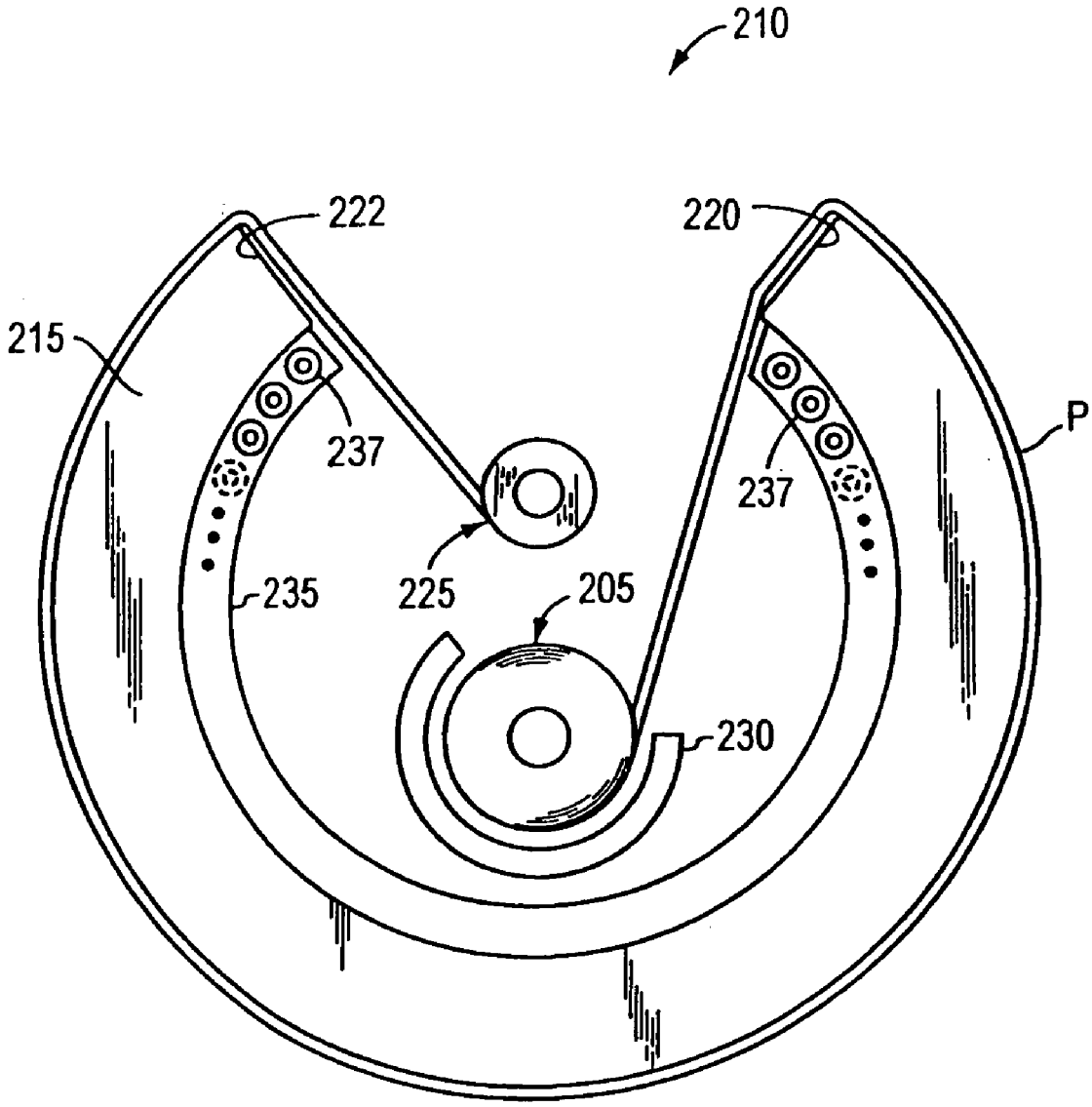
FIG. 2 is a schematic end view of a cylinder incorporating the present invention.

The techniques of the present invention are also suited to plates that are stored in roll form within a cylinder (typically the plate cylinder of a station on a printing press). The plate material may, for example, be packaged as a removable, replaceable cassette (as discussed in U.S. Pat. Nos. 5,355,795 and 5,435,242), or on a supply spool that may be introduced into and withdrawn from the body of the cylinder (see U.S. Pat. No. 5,727,749). As illustrated in FIG. 2, plate material from a supply spool 205 emerges from a space or gap 210 in a cylinder 215, passing across a first edge 220 of the gap and wrapping around cylinder 215, then re-entering the body of cylinder 215 over the opposed edge 222 of gap 210 onto an uptake spool 225. After a printing job is completed, a suitable mechanism (as described, for example, in the '795, '242 and '749 patents, the disclosures of which are hereby incorporated by reference) causes supply spool 205 to pay out fresh plate material P, which is advanced around the exterior of cylinder 215 and wound onto uptake spool 225. Supply spool 205 is locked and uptake spool 225 continues to be wound until a desired degree of circumferential tension is established.

In accordance with the present invention, a heating element 230 having a partially cylindrical profile may circumferentially surround a portion of supply roll 205. Alternatively, a cooling element 235 (e.g., a set of refrigeration coils 237 and appropriate heat-exchange hardware) may be associated with the inner surface of cylinder 215. In general, cylinder 215 is metal, and the plate material on the surface of cylinder 215 will therefore cool by conduction.

It will therefore be seen that we have developed new and useful approaches to reducing thermally induced distortions as printing plates are loaded onto plate and/or imaging cylinders. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of mounting a printing plate on a cylinder, the method comprising the steps of:

a. establishing a temperature difference between the plate and the cylinder, a temperature of the plate exceeding a temperature of the cylinder, wherein the plate is unmounted externally to the cylinder; and b. wrapping the plate around the cylinder, the temperature difference causing the plate to shrink against the cylinder.

2. The method of claim 1 wherein the temperature difference is at least 3° C.

3. The method of claim 1 wherein the temperature difference is established by heating the plate.

4. The method of claim 3 wherein the plate is heated uniformly.

5. A method of mounting a printing plate on a cylinder, the method comprising the steps of:

a. establishing a temperature difference between the plate and the cylinder; temperature of the plate exceeding a temperature of the cylinder;

b. wrapping the plate around the cylinder, the temperature difference causing the plate to shrink against the cylinder, wherein the plate is drawn from a roll disposed within the interior of the cylinder and advanced around an exterior surface of the cylinder.

6. The method of claim 5 wherein the roll is heated.

7. The method of claim 5 wherein the exterior surface of the cylinder is cooled.

8. Apparatus for mounting a printing plate on a cylinder, the apparatus comprising:

a. means for establishing a temperature difference between the plate and the cylinder, wherein the plate is mounted externally to the cylinder and a temperature of the plate exceeds a temperature of the cylinder; and b. means for facilitating wrapping the plate around the cylinder, the temperature difference causing the plate to shrink against the cylinder.

9. The apparatus of claim 8 wherein the facilitating means comprises registration pins and clamps.

10. The apparatus of claim 8 wherein the temperature difference is at least 3 ° C.

11. The apparatus of claim 8 wherein the means for establishing the temperature difference comprises means for heating the plate.

12. The apparatus of claim 11 wherein the heating means comprises a heated surface conforming substantially to the plate.

13. Apparatus for mounting a printing plate on a cylinder, the apparatus comprising:

a. means for establishing a temperature difference between the plate and the cylinder such that a temperature of the plate exceeds a temperature of the cylinder; and b. means for facilitating wrapping the plate around the cylinder, the temperature difference causing the plate to shrink against the cylinder, wherein the plate is drawn from a roll disposed within the interior of the cylinder and advanced around an exterior surface of the cylinder, the facilitating means comprising:

(i) means, within the interior of the cylinder, for supporting the roll of plate material; and (ii) means, within the interior of the cylinder, for receiving plate material extending over a travel path from the roll of plate material over the exterior surface of the cylinder.

14. The apparatus of claim 13 wherein the means for establishing a temperature difference comprises means for heating the roll.

15. The apparatus of claim 13 wherein the means for establishing a temperature difference comprises means for cooling at least the exterior surface of the cylinder.

* * * * *

UNITED STATES PATENT AND TRADEMARK OFFICE

CERTIFICATE OF CORRECTION

PATENT NO. : 6,868,608 B2
DATED : March 22, 2005
INVENTOR(S) : Theriault et al.

It is certified that error appears in the above-identified patent and that said Letters Patent is hereby corrected as shown below:

Column 5,
Line 8, ";" should be deleted and replaced with -- , a --.

Signed and Sealed this

Eighth Day of November, 2005

JON W. DUDAS
*Director of the United States Patent and Trademark Office*